US007021102B2

(12) United States Patent
Schmauder

(10) Patent No.: US 7,021,102 B2
(45) Date of Patent: Apr. 4, 2006

(54) BENDING MACHINE WITH BENDING TOOLS ON OPPOSITE SIDES OF A TOOL PLATEN

(75) Inventor: Frank Schmauder, Metzingen (DE)

(73) Assignee: Trumpf Rohrtechnik GmbH + Co. KG, Reutlingen-Mittelstadt (DE)

( * ) Notice: Subject to any disclaimer, the term of this patent is extended or adjusted under 35 U.S.C. 154(b) by 244 days.

(21) Appl. No.: 10/798,105

(22) Filed: Mar. 10, 2004

(65) Prior Publication Data

US 2004/0200252 A1 Oct. 14, 2004

(30) Foreign Application Priority Data

Mar. 15, 2003 (EP) ..... 03005462

(51) Int. Cl.
*B21D 7/04* (2006.01)

(52) U.S. Cl. ..... 72/149; 72/157

(58) Field of Classification Search ..... 72/149, 72/154, 155, 157, 159
See application file for complete search history.

(56) References Cited

U.S. PATENT DOCUMENTS 2,488,896 A * 11/1949 Bertolini et al. ..... 72/19.4
4,201,073 A * 5/1980 Eaton ..... 72/155
4,485,658 A * 12/1984 Stewart et al. ..... 72/149
4,843,859 A * 7/1989 Togoshi ..... 72/149
5,263,350 A 11/1993 Crippa
5,499,522 A * 3/1996 Schwarze ..... 72/157
6,038,903 A 3/2000 Traub
6,192,728 B1 2/2001 Hu
6,434,993 B1 * 8/2002 Broggi et al. ..... 72/157
6,854,311 B1 * 2/2005 Schmauder et al. ..... 72/157

FOREIGN PATENT DOCUMENTS

DE 3302888 12/1983
DE 201 20015 4/2002
JP 57-193236 11/1982

* cited by examiner

*Primary Examiner*—Derris H. Banks
*Assistant Examiner*—Teresa M. Bonk

(57) ABSTRACT

A bending machine for the bending of rod-shaped and/or bar-shaped workpieces and especially of pipes incorporates a bending device (5) with bending tools (10, 11) that are provided on both sides of a tool platen (12). These bending tools (10, 11) include in each case a bending swage (13, 16) and at least one thrust member. At least one thrust member on one side of the tool platen and at least one thrust member on the other side of the tool platen (12) are drivingly coupled for joint movement in the transverse direction of the workpiece, with the movement in the transverse direction of the workpiece for shifting the thrust member(s) on one side of the tool platen (12) into its or their operating position permitting movement of the associated thrust member(s) on the other side of the tool platen (12) in the opposite direction. As an alternative or in addition, the thrust members are in the form of slide rails (15, 18), drivingly coupled on both sides of the tool platen (12) for movement in the longitudinal direction of the workpiece.

20 Claims, 11 Drawing Sheets

BENDING MACHINE WITH BENDING TOOLS ON OPPOSITE SIDES OF A TOOL PLATEN

BACKGROUND OF THE INVENTION

This invention relates to a bending machine for bending rod-shaped and/or bar-shaped workpieces and in particular pipes, employing a bending device that encompasses selectively deployable bending tools of which at least one is provided on one side and at least one on the opposite side of a tool platen, each of which tools includes at least one bending swage and at least one thrust member, which for switching between an operating and an idle position can be power driven back and forth in the transverse direction of the workpiece. The bending swages are positioned on a bending axis that extends in the transverse direction of the workpiece, with the operating position of at least one thrust member on one side of the tool platen permitting the concurrent idling of at least one thrust member on the other side of the tool platen while the workpiece on the active bending tool, when effectively impacted in the transverse direction of the workpiece, can be bent around the bending swage by means of at least one of the thrust members when in its operating position.

The invention relates in particular to a bending machine of this type that employs thrust members in the form of slide rails, whereby, as the workpiece is bent around the bending swage, it can be braced on the active bending tool in the transverse direction of the workpiece by at least one slide rail that has assumed its operating position in the transverse direction of the workpiece.

Bending machines of the type referred to above have been described in European Patent No. B-0 538 207. These prior-art designs incorporate multi-level bending tools that are positioned on opposite sides of a tool platen and encompass in each case several bending swages in an over-under arrangement in the direction of a bending axis as well as clamping jaws and slide rails that interact with the bending swages. These are conventional rotational bending tools whose clamping jaws and slide rails can be moved back and forth between their operating and their idle position by means of a hydraulic drive system. In the case of the prior-art design, the clamping jaws and slide rails on one side of the tool platen are activated and moved independently of the clamping jaws and slide rails on the opposite side of the tool platen, for which purpose the clamping jaws and slide rails on either side of the tool platen have their own individual hydraulic drive systems in the form of hydraulic piston-and-cylinder units.

A conceptually different bending machine is described in German Patent 33 02 888. That machine features a bending head for the joint processing of two pipes, which, for that purpose, is provided with two simultaneously operable rotational bending tools. By means of a single piston and cylinder unit the clamping jaws of the two rotational bending tools can be jointly moved into an operating or an idle position. Accordingly, the slide rails of these two earlier rotational bending tool designs are jointly driven back and forth in the transverse direction of the workpiece by a single piston and cylinder unit between an operating position next to the workpiece and an idle position retracted from the workpiece. In the longitudinal direction of the workpiece the slide rails of the two bending tools are moved along by the pipes in process as these are being bent. In other words, no feed drive is provided for moving the slide rails during the processing of the pipes. Once the two pipes in process have been bent, a common piston and cylinder unit retracts the slide rails jointly into their home position.

It is the objective of this invention to provide a bending machine which is structurally simplified from the first-mentioned prior art design while ensuring optimal functional reliability.

SUMMARY OF THE INVENTION

It has now been found that the foregoing and related objects may be readily attained in a bending machine for the bending of rod-shaped and bar-shaped workpieces. The machine includes a support for the workpiece, a tool platen, and a bending device comprising selectively deployable bending tools at least one of which is provided on one side of the platen and at least one other tool is provided on the opposite side of the tool platen. Each bending tool includes at least one bending swage and at least one thrust member, the swage and thrust member being power driven in the transverse direction of the workpiece between an operating and idle position. The bending swage is positioned along a bending axis that extends in the transverse direction of the workpiece. The operating position of at least one thrust member on one side of the tool platen is coordinated with the idle position of at least one thrust member on the other side of the tool platen, whereby, the workpiece on the active bending tool, when effectively impacted in the transverse direction of the workpiece, can be bent around the bending swage by means of at least one thrust member in its operating position. At least one thrust member on one side and at least one thrust member on the other side of the tool platen are coupled and jointly driven for their movement in the transverse direction of the workpiece, whereby, as the thrust member on one side of the tool platen is moved in the transverse direction into its operating position, the associated thrust member on the other side of the tool platen can be moved the opposite way in the transverse direction of the workpiece.

Preferably, the mutually associated thrust members are capable of moving in opposite ways in the transverse direction of the workpiece. Clamping jaws are provided, at least one of which is positioned on one side of the tool platen and at least another one of which is positioned on the other side of the tool platen. The clamping jaws are mounted on a swivel arm that can be swiveled around the bending axis, to clamp the workpiece on the active bending tool between the bending swage. At least one clamping jaw in its operating position forces the workpiece against the bending swage, whereby the clamped workpiece can be bent around the bending swage as the swivel arm with the clamping jaws is swiveled.

The bending tool includes mutually associated thrust members capable of moving in opposite ways in the transverse direction of the workpiece and slide rails. At least one of the side rails is positioned on one side of the tool platen and at least another one of the side rails which is positioned on the other side of the tool platen. The thrust members and side rails, as viewed in the longitudinal direction of the workpiece are situated on the far side of the bend to be produced relative to the clamping jaws of the respective bending tools. As the workpiece is bent on the active bending tool around the bending swage, the workpiece is buttressed in the transverse direction of the workpiece by means of at least one slide rail that is in its operating position in the transverse direction of the workpiece.

Desirably, the bending tools are provided on both sides of the tool platen with thrust members each in the form of at least one clamping jaw and at least one slide rail. At least one clamping jaw on one side of tool platen and at least one clamping jaw on the other side of the tool platen are drivingly coupled for movement in the transverse direction of the workpiece and can be moved in the opposite direction. As the workpiece is being bent, at least one of the slide rails of the active bending tool, when in its operating position, can be moved in power-driven fashion in-the longitudinal direction of and jointly with the workpiece.

In one form of the invention, is buttressed by means of at least one slide rail that is in its operating position in the transverse direction of the workpiece. At least one slide rail of the active bending tool, when in its operating position in the transverse direction of the workpiece, can be power driven in the longitudinal direction of and jointly with the workpiece as the workpiece is being bent. The slide rails are drivingly coupled to at least one idle slide rail of a bending tool on the opposite side of the tool platen for movement in the longitudinal direction of the workpiece.

As indicated in claim 1, the design per this invention employs thrust members on both sides of the tool platen which for their joint travel in the transverse direction of the workpiece are coupled and moved-by a common drive. Accordingly, at least one thrust member on one side of the tool platen is moved in the transverse direction of the workpiece jointly with at least one thrust member on the other side of the tool platen. By virtue of this configurational concept it is possible to use the same drive components for moving thrust members which on the two sides of the tool platen are in different positions, i.e. respectively in an operating and in an idle position. The result is a structurally simple drive configuration notwithstanding the different positions of the thrust members on the two sides of the tool platen. Significantly, the multi-purpose utilization of one and the same set of drive elements makes for a small bulk of the overall drive system. That in turn permits the positioning of the thrust member drive immediately next to the bending tools. The result is a short, low mass drive train. In that context, the advantages of the coupling of the slide rail drives on the two sides of the tool platen for their joint movement in the longitudinal direction of the workpiece, described in patent claim 8, will be evident. As specified in claim 8, while in bending machines according to this invention the slide rails on both sides of the tool platen can be moved in the transverse direction of the workpiece and thus into different positions, the movement of these slide rails in the longitudinal direction of the workpiece is driven in coupled fashion.

According to patent claim 1, optimal operational reliability even with this advantageous drive configuration is ensured by the opposite movement of the jointly driven thrust members in the transverse direction of the workpiece. This feature makes it possible to move the respective thrust members on both sides of the tool platen in the transverse direction of the workpiece into setpoint positions without requiring any particular mutual adjustment of the thrust members. For example, when a thrust member on an active bending tool is moved into its operating position where it strikes the workpiece that is to be bent, the associated thrust member(s) on the opposite side of the tool platen will necessarily be moved the opposite way and thus into an area away from that in which the bending tool concerned lines up with the workpiece, thus eliminating any threat of a collision with an obstruction of one kind or another. The movement in opposite directions as provided for by this invention is of particular significance in the case of clamping jaws that clamp workpieces on the bending swage for the bending process. If in contrast to this invention such clamping jaws, positioned on both sides of the tool platen, were to travel in the same transverse direction of the workpiece, it would be possible, even before the clamping jaw of the active bending tool reaches its operating position, for the idle clamping jaw on the opposite side of the tool platen to collide with the associated bending swage. With a coupled drive and movement of the clamping jaws, the clamping jaw that is to be deployed for the bending process would be prevented from reaching its operating position. This danger would exist especially in cases where the bending swages provided on mutually opposite sides of the tool platen have different bending radii. Malfunctions of this type and corresponding downtimes could be avoided only by complex measures for the mutual adjustment of the clamping jaws positioned on both sides of the tool platen in the transverse direction of the workpiece.

As is evident from patent claim 8, bending machines designed in accordance with this invention achieve the necessary operational reliability in combination with a simple drive configuration by virtue of the fact that at least one of the slide rails of the active bending tool, when in its operating position in the transverse direction of the workpiece, is driven in the longitudinal direction of the workpiece jointly with the latter as that is being bent. In this fashion for instance a relative movement between the slide rail and the workpiece, potentially compromising the result of the bending process, can be minimized or altogether prevented. At the same time at least one slide rail on the side of the tool platen opposite the active bending tool will be in its idle position, meaning a position, as viewed in the transverse direction of the workpiece, in which any collision especially with the associated bending swage is rendered impossible.

Claims 2 and 3 pertain to the use of the novel concept of claim 1 in bending machines employing thrust members in the form of clamping jaws and/or slide rails. The particular advantages of implementing this invention with jointly driven clamping jaws moving the opposite way have already been explained above.

The novel design concept described in patent claim 4 combines the advantages of a coupled drive of clamping jaws on both sides of the tool platen and the opposite direction of travel of these clamping jaws in the transverse direction of the workpiece with the advantages of slide rails power driven in the longitudinal direction of the workpiece.

Patent claim 5 describes bending machines in which slide rails on both sides of the tool platen are coupled to be jointly driven in the longitudinal direction of the workpiece. The advantages of such a coupled drive system have been explained above in connection with claim 8.

In another preferred variation of the invention per claim 1, the slide rails that are coupled for joint travel in the longitudinal direction of the workpiece can move in parallel on both sides of the tool platen in the longitudinal direction of the workpiece (claim 6). This ensures that, viewed in the longitudinal direction of the workpiece, the respectively associated slide rails of the active and the inactive bending tool will always be in the proper position relative to each other. All of the slide rails concerned will be either in the forward position or in the retracted position. When in the longitudinal direction of the workpiece the slide rail on the active bending tool is in its retracted home position, the associated slide rail on the inactive bending tool cannot be in a forward position in which it would interfere with the swivel movement of the bending arm around the bending axis for processing the workpiece.

Particular advantages in implementing the novel basic concept per patent claim 1 are also offered by the machine design version described in claim 7. Bending machines of that type feature bending tools or bending swages on both sides of the tool platen with different bending radii. Associated with each such bending swage as an additional bending-tool component are at least one clamping jaw and at least one slide rail. The slide rail of the active bending tool, when in its operating position on the workpiece to be bent, will travel with the bent workpiece in the longitudinal direction of the latter. This slide rail is jointly driven with at least one slide rail of an inactive bending tool on the opposite side of the tool platen. As a result of this coupled drive system the inactive slide rail moves synchronously with the slide rail that is in the operating position in the longitudinal direction of the workpiece. Both the slide rail of the active bending tool and the slide rail of the inactive bending tool follow the movement of the associated clamping jaw or jaws. The clamping jaws of the active bending tool and the clamping jaws of the inactive bending tool are positioned on one and the same swivel arm so that, as the workpiece is being bent, they jointly swivel around the bending axis. Because of the different bending radii of the bending tools positioned on the two sides of the tool platen, the circular arc described by the clamping jaws as they rotate around the bending axis in their workpiece processing operating position will exhibit different radii as well. The speed at which the slide rail travels in its operating position in the longitudinal direction of the workpiece matches the speed of the associated clamping jaw that bears down on the workpiece being processed. Especially in the initial phase of the bending operation the slide rail follows the leading clamping jaw as closely as possible in the longitudinal direction of the workpiece.

When a workpiece is bent by the bending tool with a larger bending radius, the corresponding clamping jaw will swivel around the bending axis along a travel path with a relatively large radius. Correspondingly, viewed from the angle of rotation, the clamping jaw travels over a relatively large circular distance and the associated slide rail moves at a relatively high speed in the longitudinal direction of the workpiece. It is only at an appropriately high speed that in the initial phase of the bending process the slide rail can follow the clamping jaw at a consistently short distance.

In the simplest form of the coupled drive of the slide rails on both sides of the tool platen the speed of the slide rail of the inactive bending tool with a relatively small bending radius is quantitatively identical to the speed of the slide rail of the active bending tool with a larger bending radius, meaning that the slide rail of the bending tool with the smaller bending radius as well will travel at a relatively high speed in the longitudinal direction of the workpiece. If the clamping jaw of the inactive bending tool with the smaller bending radius is positioned close to the associated bending swage, it will travel around the bending axis along an arc with a relatively small radius during the bending process in which the active bending tool is engaged, and thus over a relatively short circular path. At the same time it is followed by the associated slide rail, but at a relatively high speed adapted to the conditions at the active bending tool with a larger bending radius. Consequently, in the case of the bending tool with a smaller bending radius a collision between slide rail and clamping jaw would be possible.

According to the invention, any such collision is prevented by virtue of the opposite movement of the slide rails and/or clamping jaws of the bending tools situated on both sides of the tool platen. This movement in opposite directions ensures that, as the slide rail of the active bending tool and/or the clamping jaw of the active bending tool is shifted into its operating position, the slide rail and/or the clamping jaw on the inactive bending tool with the smaller bending radius is/are moved far enough to a point where, during the bending process in which the swivel arm is rotated with the clamping jaws of the bending tools on both sides, a collision between the slide rail and the clamping jaw on the inactive bending tool with the small bending radius is avoided. To that effect it is merely necessary to move the slide rail on the inactive bending tool in the transverse direction of the workpiece and thus into a position in which it can "pass" the associated clamping jaw during the bending process. It would be equally possible to simply move the clamping jaw of the inactive bending tool with the small bending radius far enough away from the bending axis so that in the ensuing bending process it travels along a path with a large radius and thus at a speed-at which the trailing slide rail cannot "catch up" with it. The preferred solution according to this invention is for the slide rail or rails as well as the clamping jaw or jaws of the inactive bending tool to travel in the opposite direction of the movement of the active bending tool.

The novel design variation according to patent claim 12 reflects a particularly extensive simplification of the drive systems provided for the bending tools of the machine. The slide rails on both sides of the tool platen are jointly driven for their travel both in the transverse and in the longitudinal direction of the workpiece. A coupled drive is also provided for moving the clamping jaws on both sides of the tool platen in the transverse direction of the workpiece.

In a preferred configuration of this invention, the coupled drive for thrust members such as clamping jaws and/or slide rails for movement in the transverse direction of the workpiece is provided by means of at least one joint cross feed motor (patent claim 13). Correspondingly, another preferred design version of the bending machines of this invention is equipped with at least one common longitudinal drive motor for the coupled movement of the slide rails in the longitudinal direction of the workpiece. In the design version of claim 13 as well as in the design version of claim 14, particular emphasis is placed on small profile, yet powerful electric motors.

The design version of patent claim 15 utilizes the joint-drive feature as well as the mutually opposite direction of travel of the thrust members on both sides of the tool platen for movement in the transverse direction of the workpiece for the structurally simple drive-train damping of the thrust members. As specified in that claim, only two damping devices are needed for the damping of two drive trains, each in two directions of travel of the drive elements or thrust members.

As described in patent claim 16, the damping of thrust member drive trains in bending machines according to the invention with double movement, opposite travel drive elements is accomplished by means of spindles and/or spindle nuts of spindle drives that move the thrust members in the transverse direction of the workpiece. Given their rugged design and operational reliability as well as their positional accuracy these spindle drives lend themselves well to the function of driving thrust members per this invention.

Patent claim 17 describes a preferred drive configuration of this invention for the joint movement of slide rails on both sides of the tool platen in the longitudinal direction of the workpiece. The drive system, based on a three-link concept, combines high operational reliability with a relatively simple structural design. The joint longitudinal drive motor for the mutually associated slide rails on both sides of the tool platen is supported on a "floating" mount.

Patent claim 20 describes a particularly practical implementation of the floating mount for the joint longitudinal drive motor. Claims 18 and 19 cover additional preferred design features of the novel longitudinal drive for slide rails on both sides of the tool platen.

BRIEF DESCRIPTION OF THE DRAWINGS

The following will explain this invention in more detail with the aid of schematic illustrations of an implementation example, in which.

DETAILED DESCRIPTION OF THE ILLUSTRATED EMBODIMENTS

Figure 1:
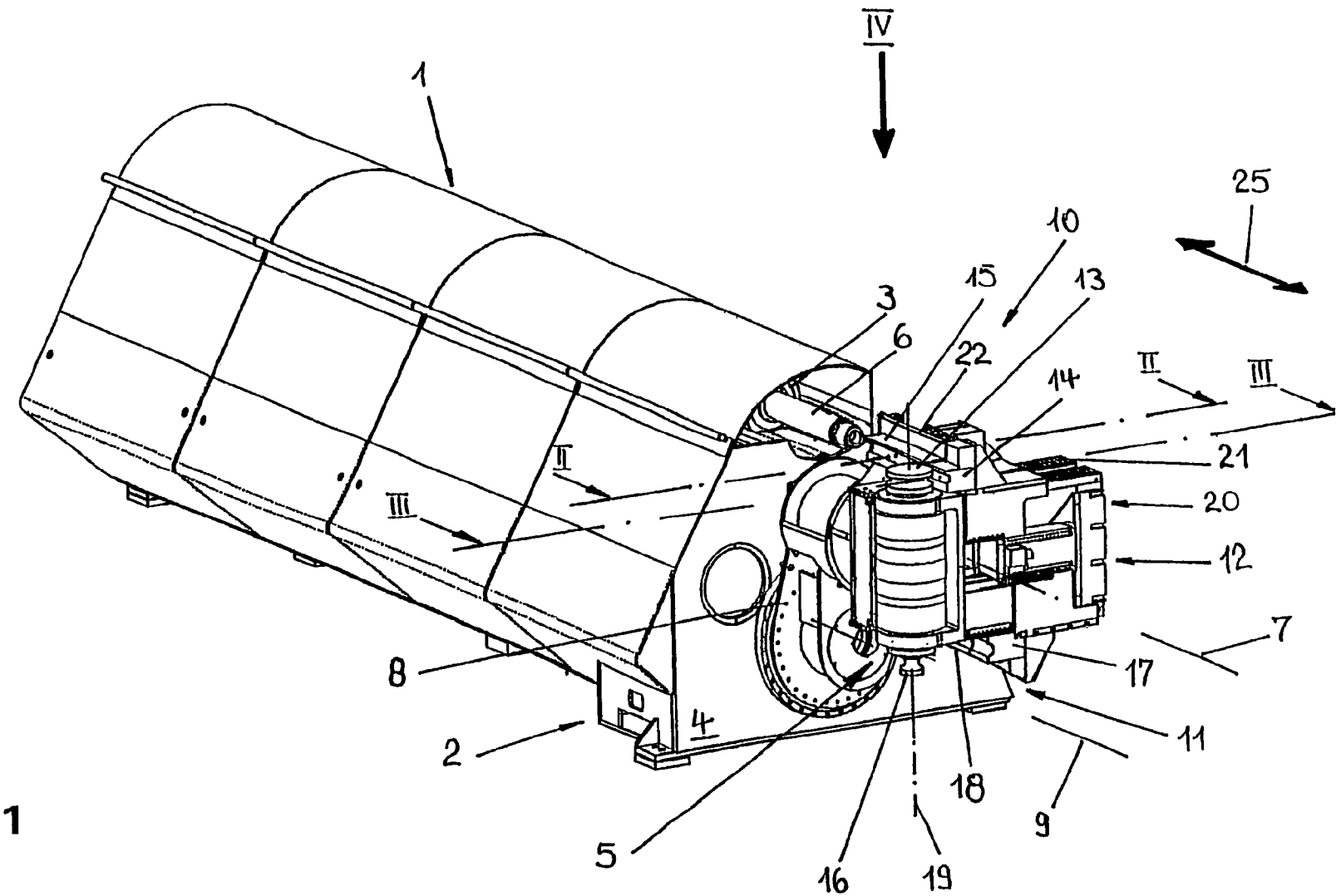
FIG. 1 is a perspective view of a bending machine embodying the present invention for the bending of pipes.

As shown in FIG. 1, a bending machine 1 for the bending of pipes includes a machine frame 2 on whose top surface a pipe feed carriage 3 can be moved in the longitudinal direction of the pipe and whose forward end 4 supports a bending device 5.

Attached to the pipe feed carriage 3 is a collet chuck 6 that serves to hold the far end, away from the bending device 5, of pipes being processed. In conventional fashion, the pipe feed carriage 3 with the collet chuck 6 permits translational movement of the pipes relative to the bending device 5 both in the longitudinal direction of the pipe and around the axis of the pipe. To avoid complexity, FIG. 1 does not show a pipe in the bending process.

The bending device 5 is mounted, rotatable around an axis of rotation 7, on a support arm 8. The support arm 8 is itself rotatable around a swivel axis 9 relative to the machine frame 2. Bending tools 10, 11 are positioned on mutually opposite sides of a tool platen 12 of the bending device 5. Depending on the rotational position of the bending device 5 relative to the axis of rotation 7 either the bending tool 10 or the bending tool 11 can be actuated for workpiece processing. Correspondingly, the bending machine 1 offers the ability to produce right or left bends. Apart from the conditions illustrated it is also possible to use multilevel bending tools.

The bending tool 10 encompasses the usual bending swage 13, a clamping jaw 14 as well as a slide rail 15. Similarly, the components of the bending tool 11 include a bending swage 16, a clamping jaw 17 and a slide rail 18. The diameter of the bending swage 13 and thus its bending radius is greater than the diameter and the bending radius of the bending swage 16. Both bending swages 13, 16 can rotate around a common bending axis 19.

Pivotable around the bending axis 19 is a swivel arm 20 of the tool platen 12, guiding in the radial direction of the bending axis 19 the clamping jaw 14 on one side of the bending tool 10 and on the opposite side the clamping jaw 17 of the bending tool 11.

Supports 22, 23 for the slide rails 15, 18 are provided on a segment 21 of the tool platen 12, which is stationary in relation to the bending axis 19, so as to be translationally movable in the transverse direction of the workpiece.

Figure 2:
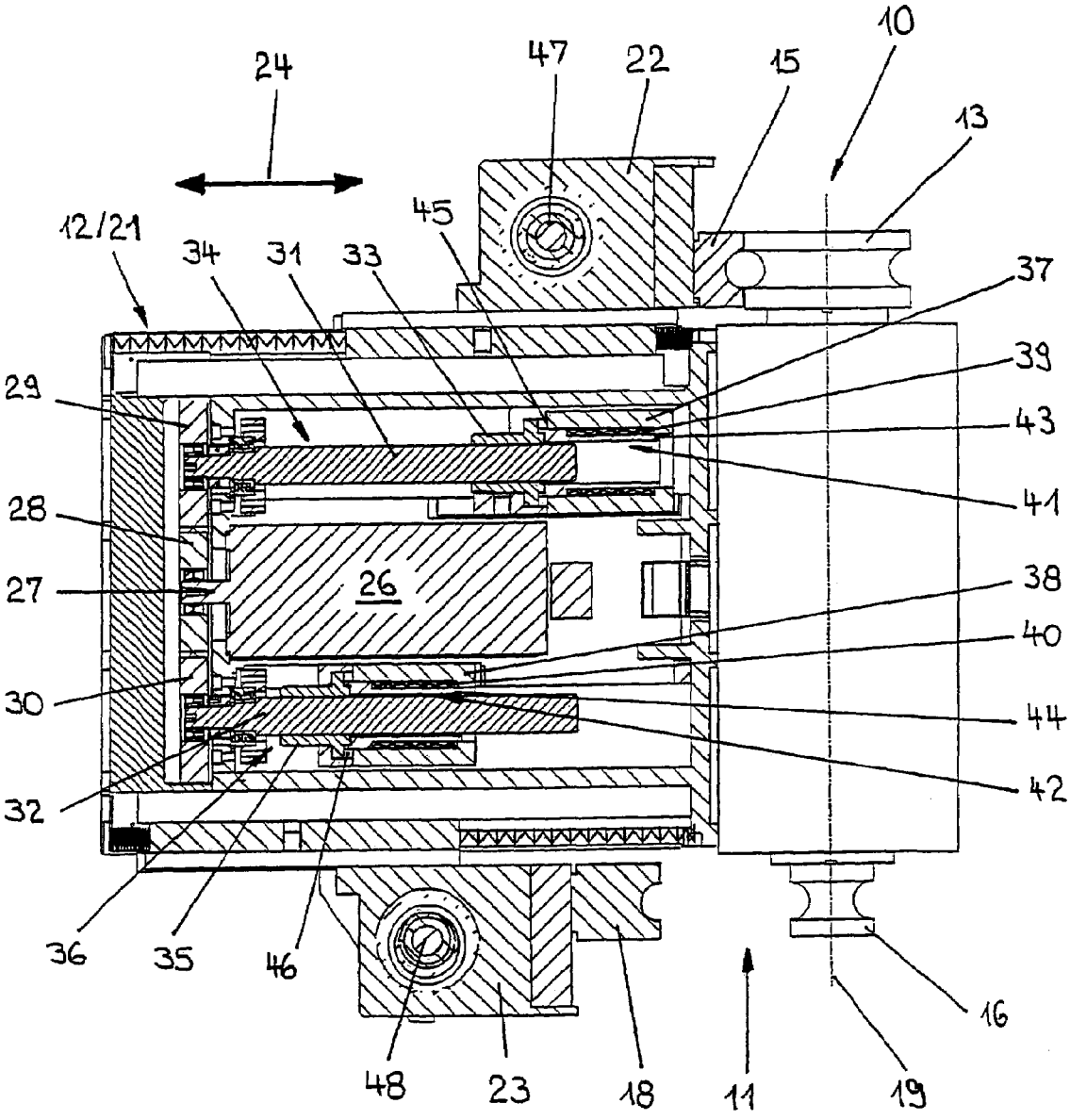
FIG. 2 is a sectional view in the plane indicated by the line II—II in FIG. 1.

FIG. 2 shows these supports 22, 23 in detail. The respective direction of travel of the supports 22, 23 and thus of the slide rails 15, 18 in the transverse direction of the pipe being processed is indicated by the double arrow 24 in FIG. 2. When in that direction the supports 22, 23 are stationary, the slide rails 15, 18 can be moved in the longitudinal direction of the pipe (double arrow 25 in FIG. 1).

As shown in FIG. 2, the supports 22, 23 with the slide rails 15, 18 are driven in the direction of the double arrow 24, i.e., in the transverse direction of the workpiece, by a common cross feed motor 26, which in the example illustrated is an electric motor. In view of its small physical size, this cross feed motor 26 can be easily accommodated in segment 21 of the tool platen 12. Mounted on the drive shaft 27 of the cross feed motor 26 is a pinion 28 that meshes with the pinions 29, 30, all rotatable about parallel axes. The pinion 29 connects to a spindle 31, the pinion 30 to a spindle 32, both in rotationally fixed fashion. Together with a spindle nut 33 the spindle 31 constitutes a spindle drive 34 while together with a spindle nut 35 the spindle 32 constitutes a spindle drive 36.

The spindle nut 33 connects to the support 22 and the slide rail 15, the spindle nut 35 to the support 23 and the slide rail 18, both in motional fashion. These connections are established by support side dogs 37, 38. In one of their directions of travel, i.e. in one of the directions indicated by the double arrow 24, the spindle nuts 33, 35 are buttressed against the support-side dogs 37, 38, by way of damping elements 39, 40 and slides 43, 44 of the damping systems 41, 42. A gap 45 or, respectively, 46 keeps the spindle nuts 33, 35 at a distance from the support-side dogs 37, 38. The slides 43, 44 can be moved in the axial direction of the spindles 31, 32, and thus in the direction of the support-side dogs 37, 38, against an elastic retractive force exerted by the damping elements 39, 40.

Given the drive configuration as implemented, actuation of the common cross feed motor 26 will move the supports 22, 23 along with the attached slide rails 15, 18 simultaneously and oppositely in the transverse direction of the workpiece. When, for example, the slide rail 15 assumes its operating position shown in FIG. 2, in which it supports the object pipe in the usual radial direction during the bending process, the slide rail 18 on the opposite side of the tool platen 12 is moved into a position away from the pipe being processed. A similar situation exists when, instead of the bending tool 10, the bending tool 11 is actuated for the workpiece processing and to that effect the slide rail 18 is transferred along the transverse direction of the workpiece into its operating position next to the workpiece.

The damping devices 41, 42 serve to protect the drive trains of the supports 22, 23 in the event of an overload.

Whenever the support 22, and with it the slide rail 15, moves along the transverse direction of the workpiece into its end position next to the workpiece, the support side dog 37, with its right-hand side seen in FIG. 2, will make contact opposite its direction of travel with the surface of the drive housing situated on the tool platen 12. If the cross feed motor 26 nevertheless continues to run, moving the spindle nut 33 in the longitudinal direction of the spindle 31, the gap 45 in front of the spindle nut 33 will close until the spindle nut 33 abuts the side of the support side dog 37 facing it. The support side dog 37 thus acts as an end stop for the spindle nut 33. The impact of the spindle nut 33 on that end stop is attenuated by the damping device 41, since the closing of the gap 45 by the spindle nut 33 takes place against the action of the damping element 39 that is compressed by the spindle nut 33 through the repositioning of the slide 43.

At the same time the damping device 41 doubles as an overload protection when the support 23 and the slide rail 18 travel to their end position away from the workpiece. As a result of the coupled drive of the spindle nuts 33, 35, any overload-related bumping of the spindle nut 35, Notionally connected with the support 23 and the slide rail 18, against the end stop located on its left side as seen in FIG. 2 and constituted of a bearing for the spindle 32 will close the gap 45 between the spindle nut 33 and the support-side dog 37. Due to the attenuating connection between the spindle nuts 33 and 35, the impact of the spindle nut 35 on its left-hand end stop in FIG. 2 is equally absorbed without requiring a separate damping device between the spindle nut 35 and its left-hand end stop. It follows that the damping device 42 serves to provide overload protection for both the movement of the support 23 and the slide rail 18 into the right-hand end position in FIG. 2 and the movement of the support 22 and the slide rail 15 into the left-hand end position as seen in FIG. 2.

In addition, the damping devices 41, 42 perform their function when the slide rails 15, 18, moving from their idle position away from the workpiece into their operating position next to the workpiece, accidentally encounter an obstruction in the transverse direction of the workpiece. Blockage of the slide rail 15 causes the damping device 41 to respond. Obstruction of the slide rail 18 brings the damping device 42 into action.

FIG. 2 also shows the spindles 47, 48 by means of which the slide rails 15, 18 can be moved in the same direction along the longitudinal direction of the workpiece when the supports 22, 23 are stationary in the longitudinal direction of the workpiece. Such longitudinal travel along the slide rail 15, 18 in the operating position along the transverse direction of the workpiece will serve for instance to prevent relative movement between the slide rails 15, 18 and the object workpiece during the processing of the workpiece. The joint drive coupling of the inactive and the active slide rails 15, 18 makes it possible to move the two slide rails 15, 18, by means of a simple drive-configuration and especially with a single common longitudinal drive motor, in the longitudinal direction of the workpiece. Coupled slide rails 15, 18 jointly driven in the longitudinal direction of the workpiece do not necessarily require a design as shown in FIG. 2 where the supports 22, 23 and the slide rails 15, 18 must also be coupled and movable in opposite directions along the transverse direction of the workpiece.

Figure 3:
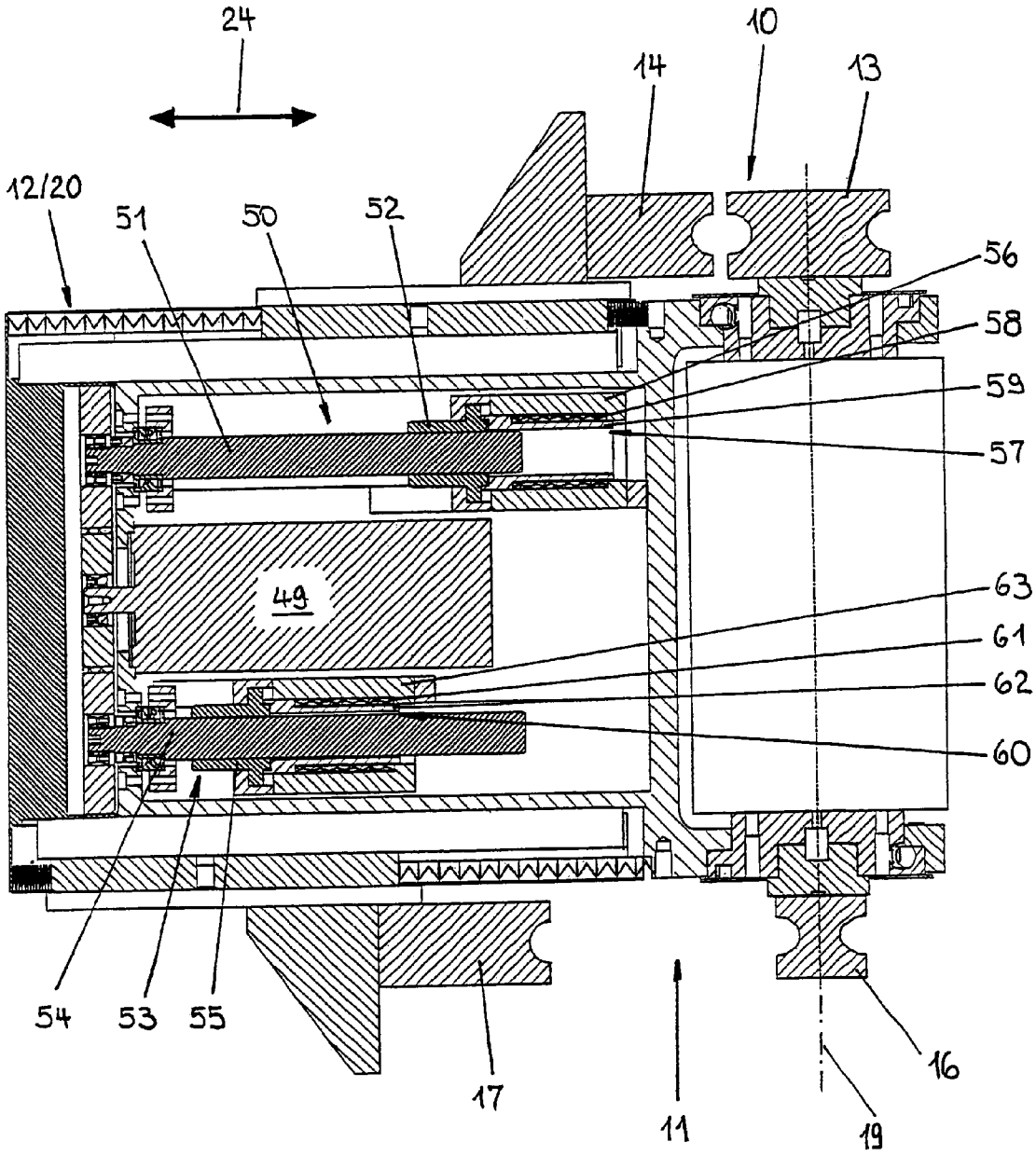
FIG. 3 is a sectional view in the plane indicated by the line III—III in FIG. 1.

FIG. 3 is a sectional view of the swivel arm 20 with attached clamping jaws 14, 17 that are guided in the radial direction of the bending axis 19. The clamping jaw 14 is in its operating position in the transverse direction of the workpiece in which it presses the object pipe (not shown) against the associated bending swage 13. The clamping jaw 17 has moved into a position in which it is relatively far from the associated bending swage 16. In the same way as the slide rails 15, 18, the clamping jaws 14, 17 are jointly driven in the transverse direction of the workpiece and can be moved in opposite directions. The drive provided for this purpose is configured in similar fashion as the cross feed drive of the supports 22, 23 and the slide rails 15, 18. Specifically, it employs a common electric cross feed motor 49 that drives the clamping jaw 14 by a spindle drive 50 with spindle 51 and spindle nut 52, and the clamping jaw 17 by the spindle drive 53 with spindle 54 and spindle nut 55, both in the transverse direction of the workpiece. Located between the spindle nut 52 and a clamping jaw dog 56 is a damping device 57 with damping element 58 and slide 59. In corresponding fashion, a damping device 60 with damping element 61 and slide 62 operates between the spindle nut 55 and a clamping jaw dog 63 motionally connected to the clamping jaw 17. In a manner analogous to the damping devices 41, 42, each damping device 57, 60 provides overload protection in the movement of the clamping jaws 14, 17 in a direction perpendicular to the bending axis 19.

Figure 4:
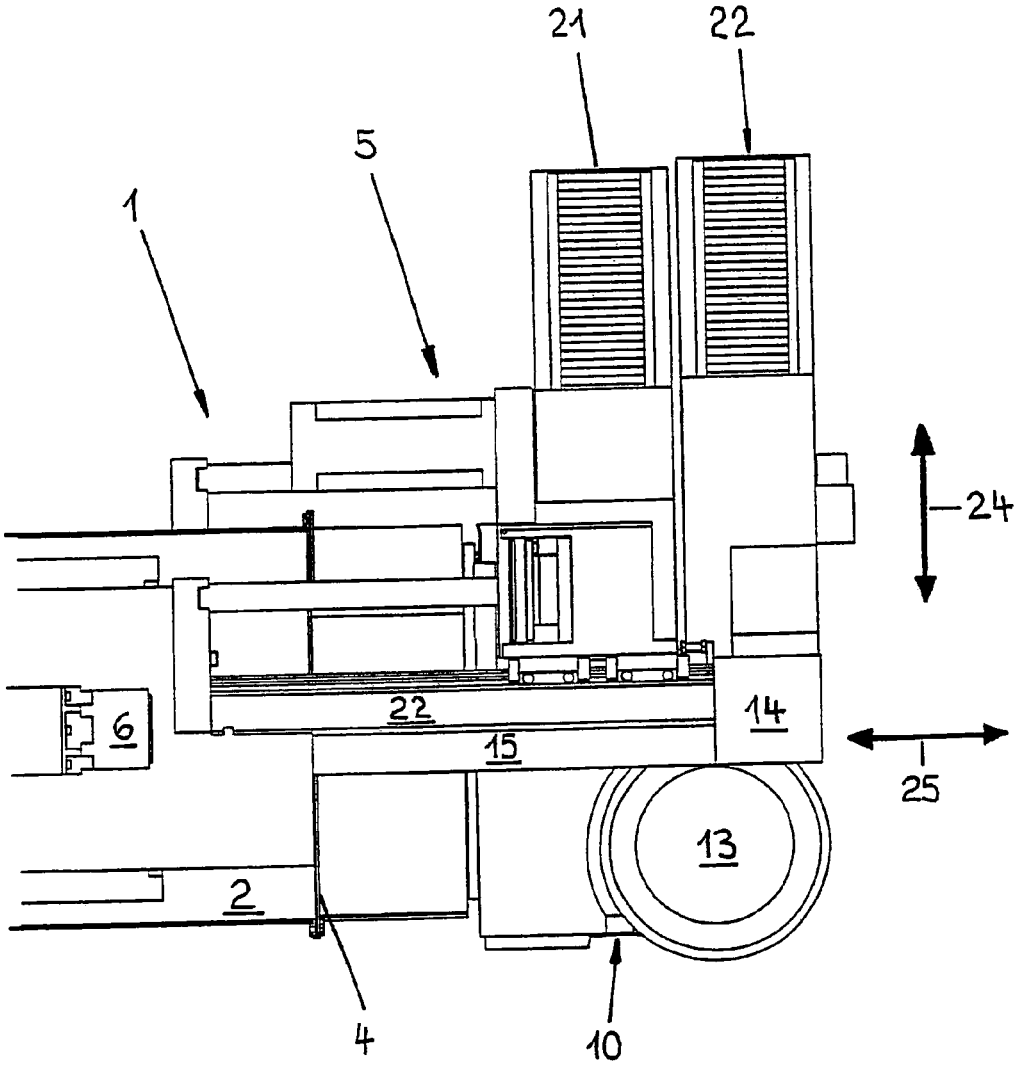
FIG. 4 is a fragmentary plan view of the bending device of the bending machine of FIG. 1 as viewed in the direction of the arrow IV in FIG. 1.

FIG. 4 is a top plan view showing the conditions at the forward end 4 of the machine frame of the bending machine. Specifically identifiable are, in particular, the collet chuck 6 that holds the far end, relative to the bending tool, of the object pipe being processed, as well as the bending tool 10 with the tool components described in detail further above.

A comparison between the FIGS. 5*a* and 5*b* and FIGS. 6*a* and 6*b*, respectively, clearly underscores the advantages of the kinematics of the clamping jaws 14, 17 and the slide rails 15, 18 in the bending machine 1.

Figure 5A:
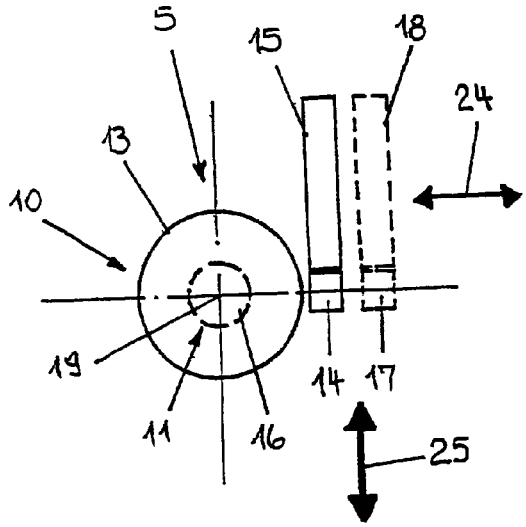
FIGS. 5*a* and 5*b* are schematic illustrations showing the bending of pipes by means of the bending device of the bending machine of FIG. 1.
Figure 5B:
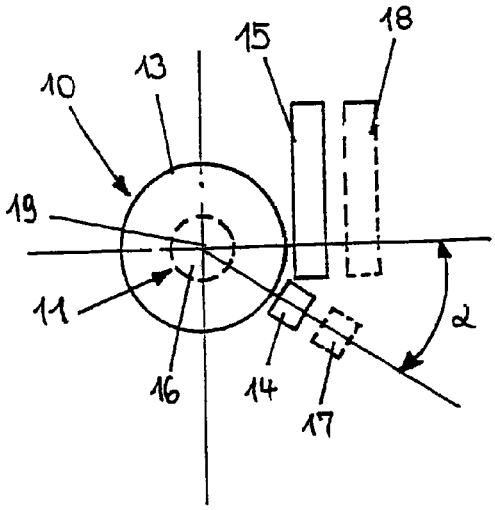

FIGS. 5*a* and 5*b* schematically illustrate, in a top view of the bending device 5, the conditions actually implemented in the bending machine 1. The bending tool 10 with bending swage 13, clamping jaw 14 and slide rail 15 is actuated for the processing and is represented by the solid lines while the bending tool 11 with bending swage 16, clamping jaw 17 and slide rail 18 remains inactive and is represented by the dotted lines.

In FIG. 5*a* the clamping jaw 14 on the bending swage 13 and the slide rail 15 are in their operational positions. To assume these positions the clamping jaw 14 and the slide rail 15 have been moved out of their idle position on the right as seen in FIG. 5*a* along the transverse direction of the workpiece. The movement of the clamping jaw 14 and the slide rail 15 into their operating position resulted in a concomitant opposite movement of the clamping jaw 17 and the slide rail 18 of the bending tool 11 into the illustrated idle position retracted from the workpiece.

In the illustrated operating position the clamping jaw 14 presses the object pipe against the bending swage 13. Consequently, the pipe is clamped tight between the bending swage 13 and the clamping jaw 14. The slide rail 15 abuts the workpiece and braces it against rightward movement as seen in FIG. 5*a*.

To produce the desired bend, the swivel arm 20 with the clamping jaws 14, 17 is rotated in conventional fashion around the bending axis 19. This is accompanied by a rotational movement of the bending swages 13, 16 around the bending axis 19. In the process, the pipe, clamped between the bending swage 13 and the clamping jaw 14, is bent in the bending tool, actuated for the processing of the workpiece, around the bending swage 13. The clamping jaw 14 traveling around the bending axis 19 is followed by the slide rail 15 jointly with the unbent part of the workpiece along a straight-line path in the longitudinal direction of the workpiece, i.e., in the downward direction of the double arrow 25.

On the inactive bending tool 11, the bending swage 16 rotates jointly with the bending swage 13 of the bending tool 10 around the bending axis 19. The clamping jaw 17 of the bending tool 11, together with the clamping jaw 14 of the bending tool 10, swivels around the bending axis 19. Because of the joint-drive coupling, the slide rail 18 of the bending tool 11 moves in the same direction with the slide rail 15 along the longitudinal direction of the workpiece. In the process, the speed of the slide rail 18 in the longitudinal direction of the workpiece matches the speed of the slide rail 15. For an optimized processing result, the slide rail 15 must closely follow the clamping jaw 14 of the active bending tool 10.

FIG. 5*b* shows the conditions when the workpiece is bent at an angle $\alpha$. The slide rail 15 of the bending tool 10 is still in close proximity to the associated clamping jaw 14. However, the distance between the clamping jaw 17 and the slide rail 18 of the bending tool 11 has increased. This is due to the fact that the clamping jaw 17 moves around the bending axis 19 with a larger radius than the clamping jaw 14, thus traveling a greater circular distance than the clamping jaw 14 while at the same time the slide rails 15, 18 are moving at a matching speed. Notwithstanding the coupled drive of the slide rails 15, 18 in their movement along the longitudinal direction of the workpiece and notwithstanding the reduced bending radius on the bending swage 16 relative to the bending radius on the bending swage 13, collisions between the clamping jaw 17 and the slide rail 18 of the currently idle bending tool 11 are thus prevented.

Figure 6A:
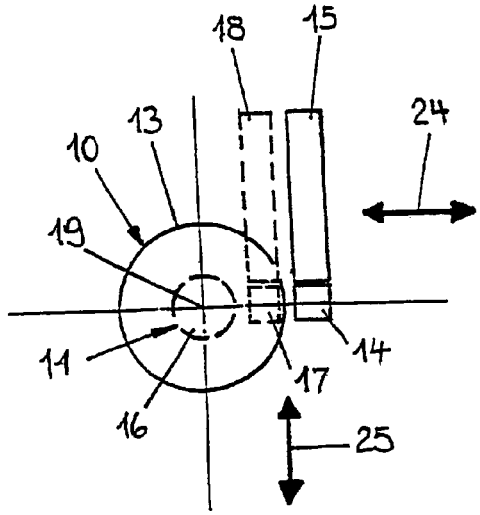
FIGS. 6*a*, and 6*b* are schematic illustrations corresponding to FIGS. 5*a* and 5*b* but with modified motion control of the bending tools of the bending device.
Figure 6B:
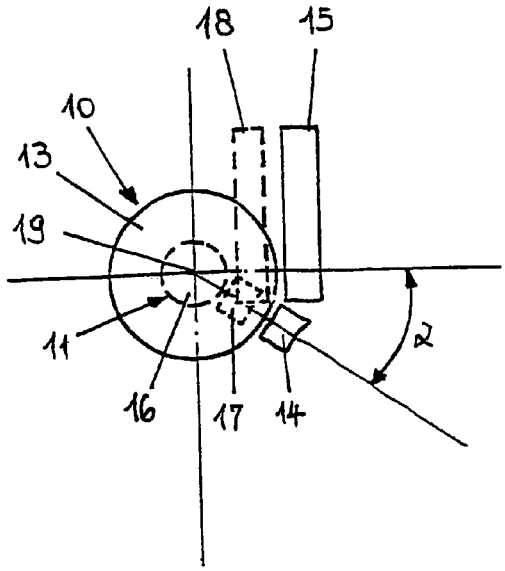

The situation would be different if the kinematics of the bending-tool components depicted in FIGS. 6*a* and 6*b* were not implemented in the bending machine 1.

The positions of the clamping jaw 14 and of the slide rail 15 in FIG. 6*a* are identical to the positions of these bending-tool components in FIG. 5*a*. In FIG. 6*a* the clamping jaw 17 and the slide rail 18 have been moved into an idle position along the transverse direction of the workpiece but not in the opposite direction of the clamping jaw 14 and the slide rail 15, in which idle position the clamping jaw 17 would be radially located outside the clamping jaw 14 in relation to the bending axis 19. Instead, the clamping jaw 17 and the slide rail 18 of the inactive bending tool 11 are themselves in their operating positions in the transverse direction of the workpiece.

As the bending tool 10 bends the object pipe, the clamping jaw 17 on the bending swage 16 with a smaller diameter than the bending swage 13 moves around the bending axis 19 along a circular path whose radius is significantly smaller than the radius of the path followed by the clamping jaw 14. Consequently, the clamping jaw 17 travels a shorter circular distance than the clamping jaw 14. Yet at the same time, the slide rail 18 trailing the clamping jaw 17 moves at the same speed at which the slide rail 15 trails its associated clamping jaw 14. The slide rail 18 will therefore try to pass the clamping jaw 17, causing it to "rear-end" the clamping jaw 17. That collision is illustrated in FIG. 6*b* by the overthrust between the clamping jaw 17 and the slide rail 18.

FIGS. 7 to 12 show a bending device 105 that differs from the bending device 5 described earlier by the design of the bending tools it employs. Specifically, the bending tools 110, 111 provided on a tool platen 112 of the bending device 105 are in the form of multilevel bending tools each of which comprises two individual tools. There are thus four individual tools with four different bending radii.

The bending tool 110 comprises along a bending axis 119 the stacked bending swages 113, 164. The bending tool 111 correspondingly encompasses the bending swages 116, 165. As additional tool components associated with the bending swages 113, 164, clamping jaws 114, 166 and slide rails 115, 167 are provided. The bending tool 111 includes the clamping jaws 117, 168 and slide rails 118, 169 in addition to the bending swages 116, 165. Appropriate positioning relative to the machine frame 2 of the bending machine 1 allows the selective deployment of one of the bending swages 113, 116, 164, 165 with the respectively associated bending tool components for the processing of a pipe, which is not shown to avoid complexity of illustration.

Figure 7:
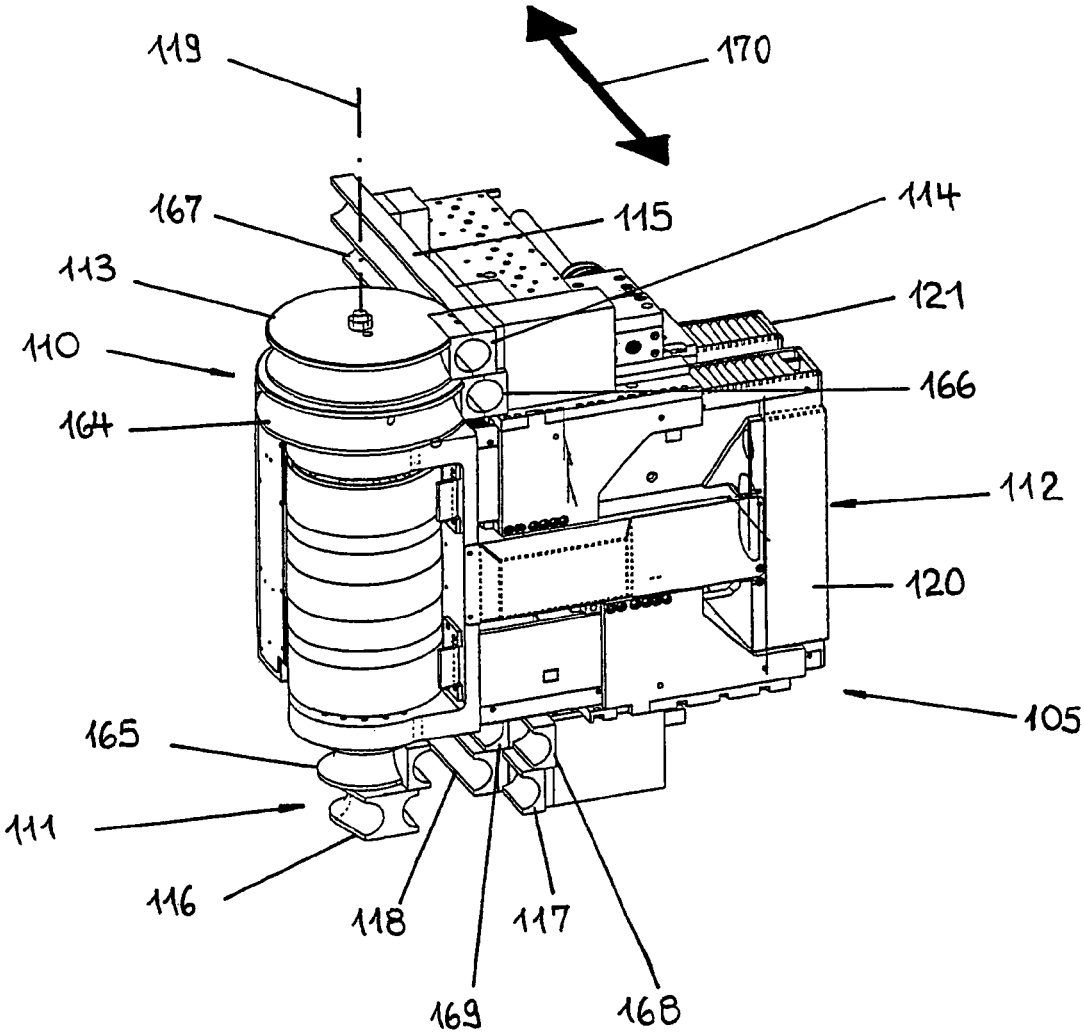
FIG. 7 is a perspective view in the direction of the machine frame of a bending device, in a variation from the preceding figures, for the bending machine according to FIG. 1, at the beginning of a bending process.
Figure 8:
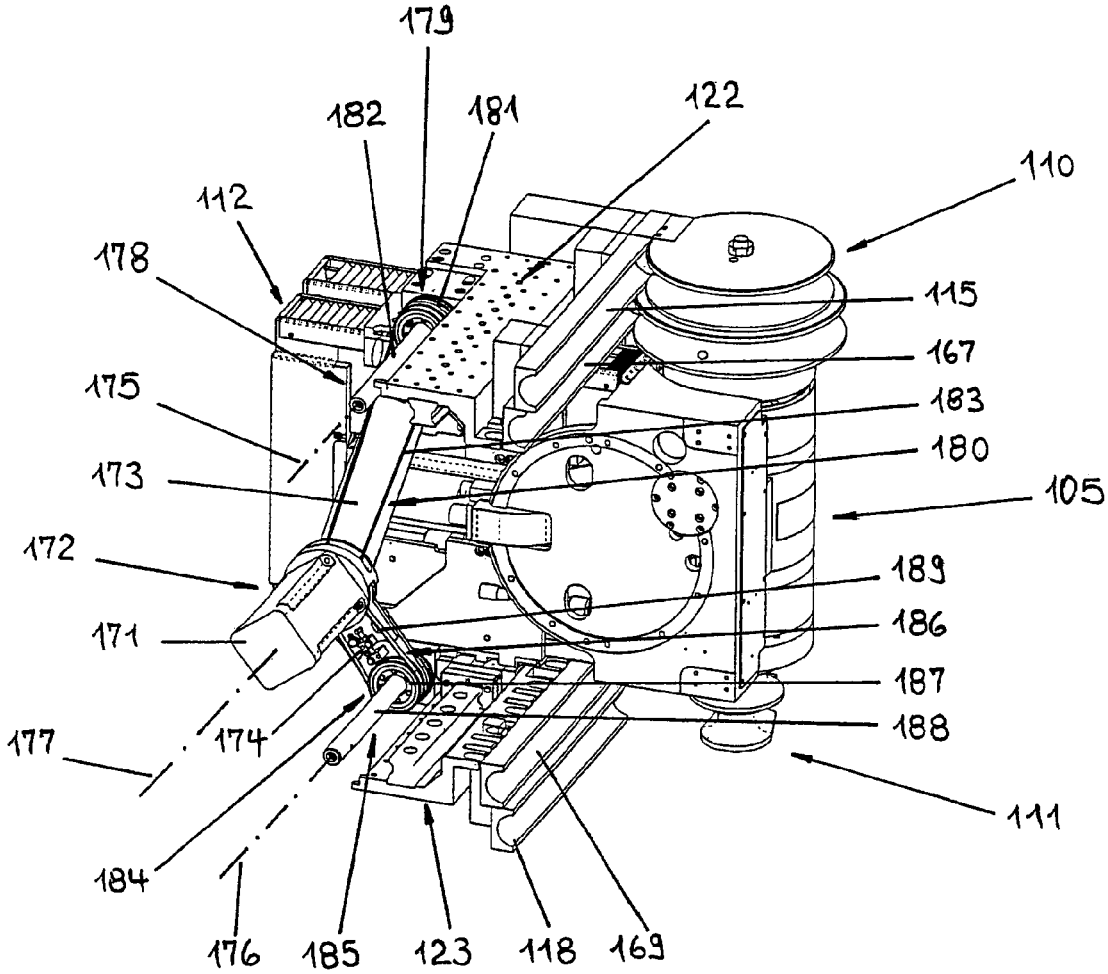
FIG. 8 shows the bending device of FIG. 7 in a perspective view from the rear of the machine frame.

In FIGS. 7 and 8 the bending device 105 is shown in its ready state for commencing a pipe-bending process. For that process the bending swage 113, clamping jaw 114 and slide rail 115 are actuated. Accordingly, the clamping jaw 114 is in its operating position in the transverse direction of the workpiece, in which position it forces the object pipe against the bending swage 113. The slide rail 115 on its part is in its operating position next to the workpiece in the transverse direction of the workpiece.

The clamping jaw 166 is movably interconnected with the clamping jaw 114. In corresponding fashion the slide rails 115, 167 constitute a jointly moving unit. Accordingly, in the same manner as the clamping jaw 114 and the slide rail 115, the clamping jaw 166 and the slide rail 167 occupy a position next to the workpiece.

The clamping jaws 117, 168 of the bending tool 111 are coupled and jointly driven with the clamping jaws 114, 166 and are shifted in opposite directions along the transverse direction of the workpiece. Correspondingly, the slide rails 118, 169 of the bending tool 111 are jointly driven with the slide rails 115, 167 of the bending tool 110 in the transverse direction of and into a position at a distance from the workpiece. The drive coupling and mutually opposite travel of the respectively associated bending tool components on both sides of the tool platen 112 is accomplished by means of cross feed motors accommodated inside a swivel arm 120 and a stationary segment 121 of the tool platen 112 and corresponding in design and functionality to the cross feed motors 26, 49 as shown in FIGS. 2 and 3.

Figure 9:
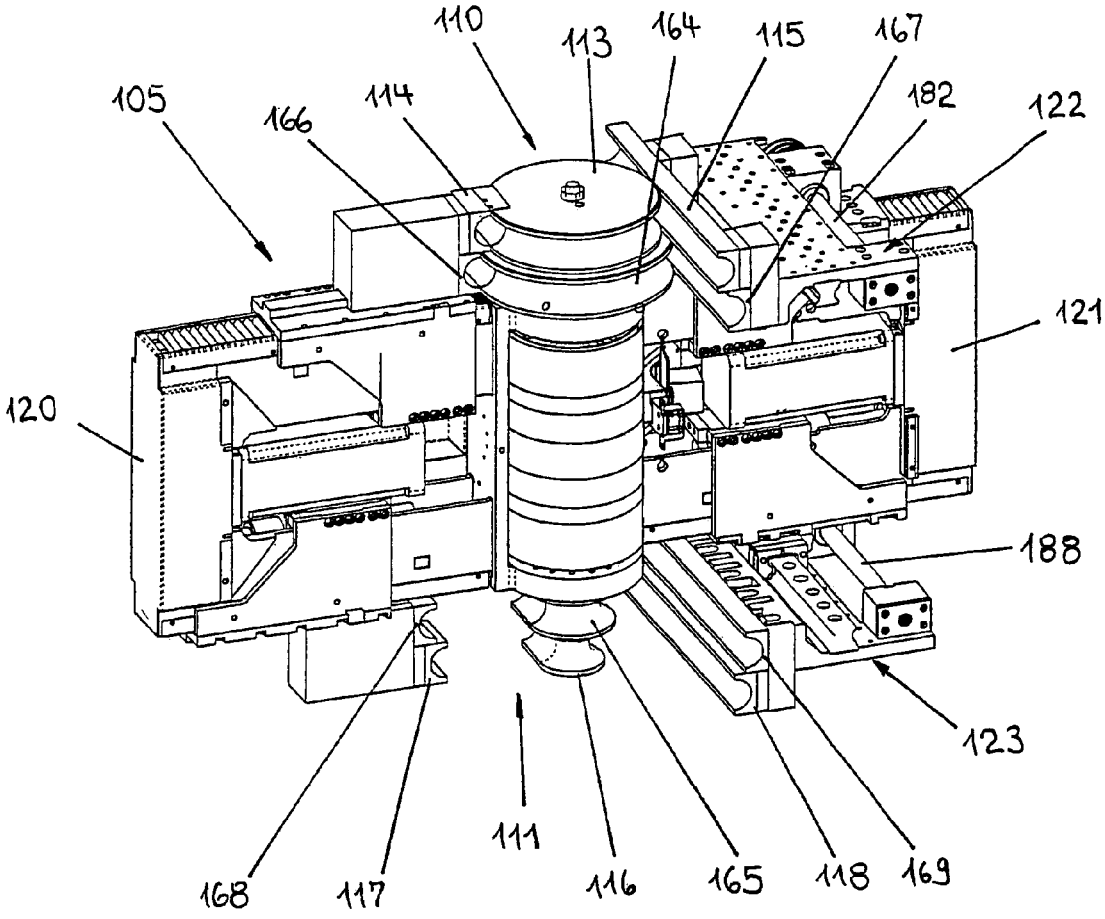
FIGS. 9 and 10 show the bending device of FIGS. 7 and 8 upon completion of a bending operation.
Figure 10:
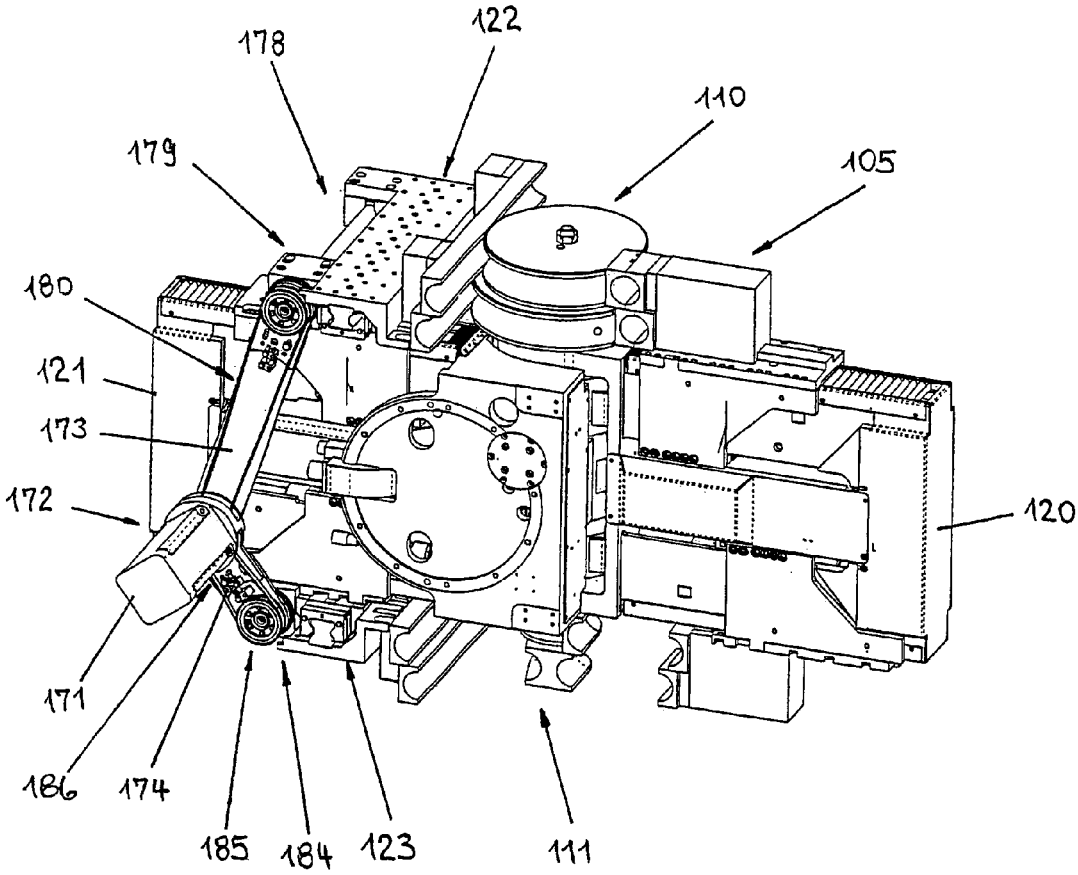
Figure 11:
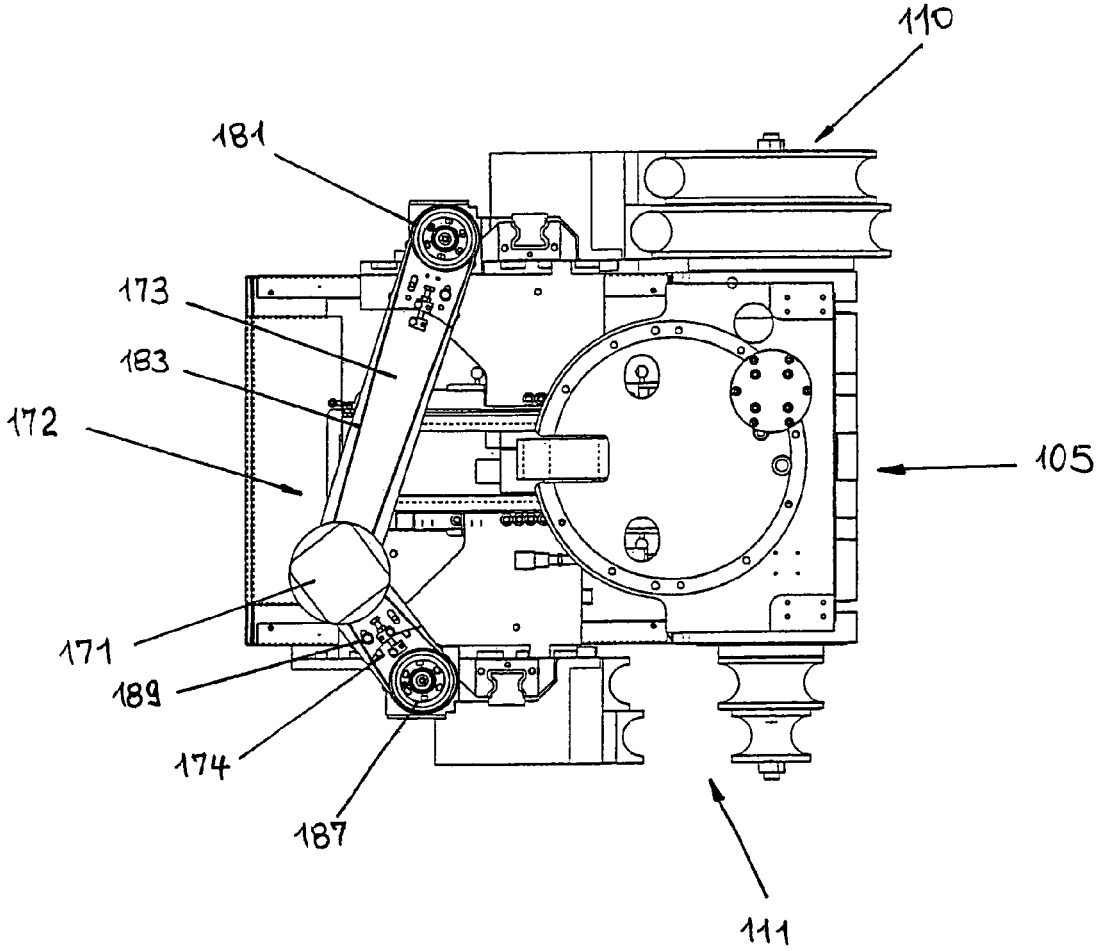
FIG. 11 is a vertical top view of the rear of the bending device of FIGS. 7 and 8.
Figure 12:
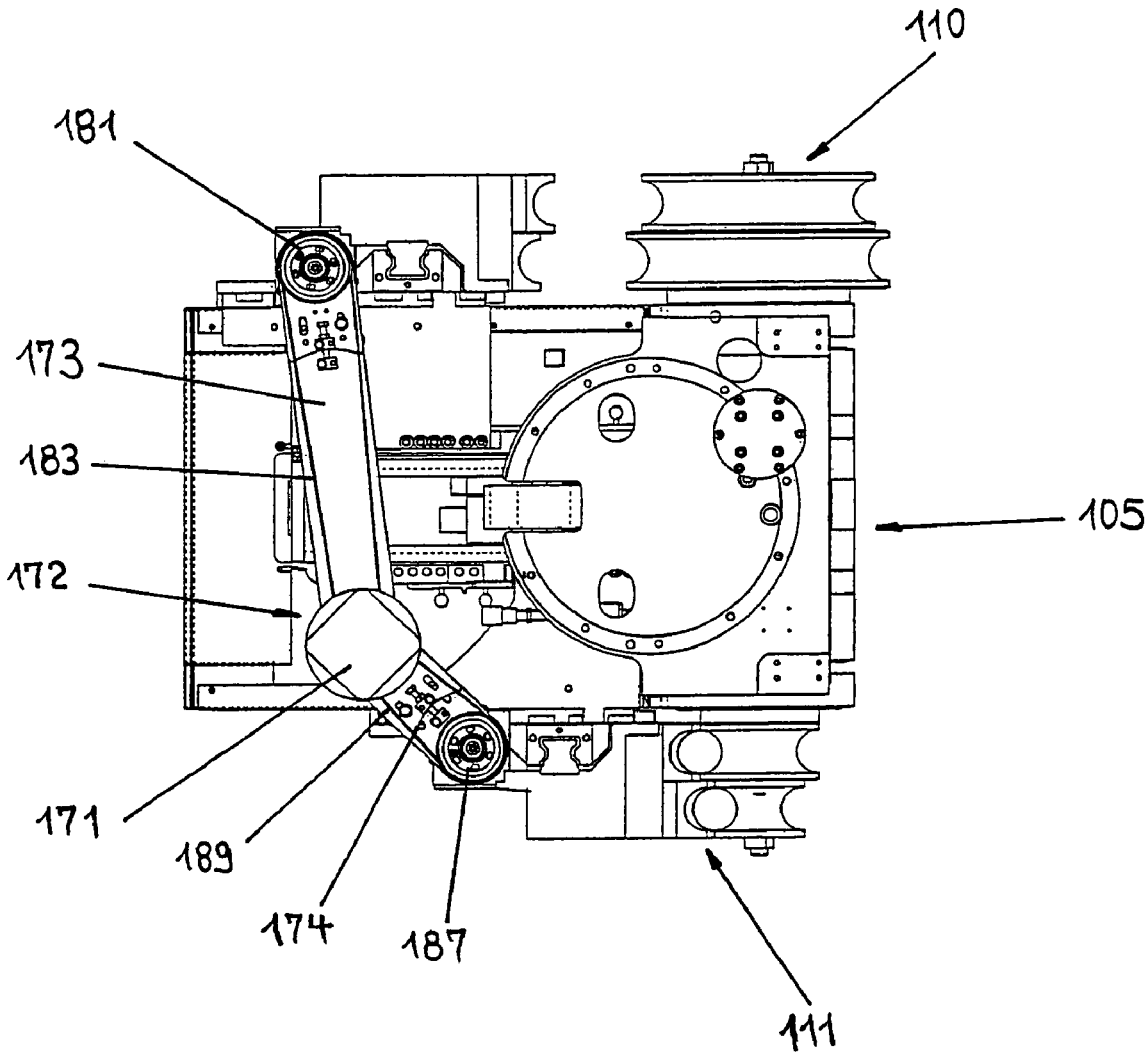
FIG. 12 shows the bending device per of FIGS. 7 through 11 in an operating state different from that depicted in FIG. 11.

For processing the object pipe using the bending swage 113, clamping jaw 114 and slide rail 115 of the bending tool 110 under the conditions depicted in FIGS. 7 and 8, the swivel arm 120 is moved around the bending axis 119 and into the position-shown in FIGS. 9 and 10. In the process the pipe, clamped in place by the bending swage 113 and the clamping jaw 114, is bent around the bending swage 113. The-pipe is laterally supported by the slide rail 115.

Linked with the movement of the swivel arm 120 with clamping jaw 114 and bending swage 113 around the bending axis 119 is a movement of the unit composed of slide rail 115 and slide rail 167 in the longitudinal direction of the workpiece (double arrow 170). This prevents any relative movement between the pipe that is pulled around the bending swage 113 and the slide rail 115, and thus any damage to the outer wall of the pipe as a result of such relative movement. In its travel in the longitudinal direction of the workpiece the assembly consisting of slide rail 115 and slide rail 167 is drivably coupled with the assembly consisting of slide rail 118 and slide rail 169 on the opposite side of the tool platen 112. Because of the coupled drive, the slide rail assemblies on both sides of the tool platen 112 move in the same longitudinal direction of the pipe being processed. The slide rail assemblies will have reached their end positions in the longitudinal direction of the workpiece when the bending device 105 is in the operating state depicted in FIGS. 9 and 10.

The slide rails 115, 167 and, respectively, the slide rails 118, 169 are coupled and jointly driven by means of a common longitudinal drive motor 171, an electric motor in the example illustrated in FIGS. 8 and 10. The longitudinal drive motor 171 is mounted on the tool platen 112 by a three-link attachment 172. The three-link attachment 172 includes a long rocker 173 and a short rocker 174. On the slide rail side the long rocker 173 is pivotably mounted on a swivel pin 175, and the short rocker 174 is pivotably mounted on a swivel pin 176. At their far ends spaced from the swivel pins 175, 176, the long rocker 173 and the short rocker 174 are connected with each other in articulated fashion. A common linkage axle 177 of the long rocker 173 and the short rocker 174 extends parallel to the swivel pins 175, 176 and coincides with the geometric axis of the motor shaft of the longitudinal drive motor 171.

The slide rails 115, 167 are driven in the longitudinal direction of the workpiece by means of a longitudinal feedgear mechanism 178 positioned between the slide rails 115, 167 and the longitudinal drive motor 171. The mechanism encompasses a spindle drive 179 and a belt drive 180. The spindle drive 179 on its part includes a spindle nut 181 rotatably mounted on a support 122 for the slide rails 115, 167, as well as a gear spindle 182 interacting with the latter. The axis of rotation of the spindle nut 181, the longitudinal axis of the gear spindle 182 and the axis of the swivel pin 175 of the long rocker 173 of the three-link attachment 172 coincide. The spindle nut 181 can be moved, together with the support 122 on which it is mounted, in the transverse direction of the workpiece. Guided on the stationary segment 121 of the tool platen 112, the gear spindle 182 of the spindle drive 179 with the slide rails 115, 167 can be shifted in the longitudinal direction of the workpiece. The combination results in a guide unit for the slide rails 115, 167 resembling a compound cross slide.

To move the gear spindle 182 and the slide rails 115, 167 in the longitudinal direction of the workpiece, the spindle nut 181 must be rotated around its axis. This is accomplished by means of a continuously revolving drive belt 183 of the belt drive 180. The drive belt 183 in turn is driven by the longitudinal drive motor 171 and constitutes a transmissive connection between the longitudinal drive motor 171 and the spindle nut 181 that serves as a feedgear element on the slide rail side. By means of the long rocker 173, the drive belt 183 can be swiveled around the swivel pin 175.

Corresponding to the slide rails 115, 167, the slide rails 118, 169 on the opposite side of the tool platen 112 are moved in the longitudinal direction of the workpiece. A longitudinal feedgear mechanism 184 encompasses a spindle drive 185 as well as a belt drive 186.

A spindle nut 187 of the spindle drive 185 is mounted on a support 123 that can move in the transverse direction of the workpiece and functions in coordination with a gear spindle 188 which together with the slide rails 118, 169 can move in the longitudinal direction of the workpiece. A drive belt 189 of the belt drive 186 establishes a transmissive connection between the longitudinal drive motor 171 and the spindle drive 185 and can be swiveled with the short rocker 174 around the swivel pin 176. The spindle nut 187 constitutes a feedgear element on the slide rail side.

The three-link mount design for the longitudinal drive motor 171 and for the longitudinal feedgear mechanisms 178, 184 makes it possible to move the slide rails 115, 167 on one side and the slide rails 118, 169 on the other side in the longitudinal direction of the workpiece, despite their movability in the transverse direction of the workpiece, by means of a single drive motor, that being the common longitudinal drive motor 171.

As a function of the positions of the slide rails 115, 167 and the slide rails 118, 169 in the transverse direction of the workpiece, there will be varying V-angles between the long rocker 173 and the short rocker 174 of the three-link attachment 172 as well as mutually deviating positions of the "floating" mount of the longitudinal drive motor 171. Examples thereof can be seen in FIGS. 11 and 12.

Given the drive configuration implemented in the example shown, four drive motors on the bending devices 5, 105 suffice for the bending of pipes with different bending radii and in mutually opposite directions. Specifically needed are two cross feed motors, one longitudinal drive motor and one swivel motor. The cross feed motors provide the opposite double motion of the mutually opposite clamping jaws 14, 17; 114, 166; 117, 168 on the tool platens 12, 112, and of the slide rails 15, 18; 115, 167; 118, 169 located on the two sides of the tool platens 12, 112. The longitudinal drive motor moves the slide rails 15, 18; 115, 167; 118, 169 in the same longitudinal direction of the workpiece. Finally, the swivel drive motor serves to perform the swivel motion of the swivel arms 20, 120 around the bending axes 19, 119. All of these drive motors are available in physical sizes that permit their direct installation on the tool platens 12, 112.

Having thus described the invention, what is claimed is:

1. A bending machine for the bending of rod-shaped and bar-shaped workpieces including:

(a) support for the workpiece:

(b) a tool platen (12, 112); and (c) a bending device (5, 105) comprising selectively deployable bending tools (10, 11; 110, 111) at least one of which is provided on one side of said platen and at least one other tool is provided on the opposite side of said tool platen (12, 112), each bending tool including at least one bending swage (13, 16; 113, 164; 116, 165) and at least one thrust member, said swage and thrust member being power driven in the transverse direction of the workpiece between an operating and idle position, said bending swages (13, 16; 113, 164; 116, 165) being positioned along a bending axis (19, 119) that extends in the transverse direction of the workpiece, the operating position of at least one thrust member on one side of the tool platen (12, 112) being coordinated with the idle position of at least one thrust member on the other side of the tool platen (12, 112), whereby, the workpiece on the active bending tool (10, 11; 110, 111), when effectively impacted in the transverse direction of the workpiece, can be bent around the bending swage (13, 16; 113, 164; 116, 165) by means of at least one thrust member in its operating position, said at least one thrust member on one side and at least one thrust member on the other side of the tool platen (12, 112) being coupled and jointly driven for their movement in the transverse direction of the workpiece, whereby, as the thrust member on one side of the tool platen (12, 112) is moved in the transverse direction into its operating position, the associated thrust member on the other side of the tool platen (12, 112) can be moved the opposite way in the transverse direction of the workpiece.

2. The bending machine in accordance with claim 1, wherein, as mutually associated thrust members capable of moving in opposite ways in the transverse direction of the workpiece, clamping jaws (14, 17; 114, 166; 117, 168) are provided, at least one of which is positioned on one side of the tool platen and at least another one of which is positioned on the other side of the tool platen (12, 112), said clamping jaws being mounted on a swivel arm (20, 120) that can be swiveled around the bending axis (19, 119), to clamp the workpiece on the active bending tool (10, 11; 110, 111) between it and the bending swage (13, 16; 113, 164; 116, 165), at least one clamping jaw (14, 17; 114, 166; 117, 168) in its operating position forcing the workpiece against the bending swage (13, 16; 113, 164; 116, 165), whereby the clamped workpiece can be bent around the bending swage (13, 16; 113, 164; 116, 165) as the swivel arm (20, 120) with the clamping jaws (14, 17; 114, 166; 117, 168) is swiveled.

3. The bending machine in accordance with claim 1 wherein there are included mutually associated thrust members capable of moving in opposite ways in the transverse direction of the workpiece, and slide rails (15, 18; 115, 167; 118, 169), at least one of said side rails being positioned on one side of the tool platen and at least another one of said side rails which is positioned on the other side of the tool platen (12, 112), said thrust members and side rails, as viewed in the longitudinal direction of the workpiece being situated on the far side of the bend to be produced relative to the clamping jaws (14, 17; 114, 166; 117, 168) of the respective bending tools (10, 11; 110, 111), whereby, as the workpiece is bent on the active bending tool (10, 11; 110, 111) around the bending swage (13, 16; 113, 164; 116, 165), the workpiece is buttressed in the transverse direction of the workpiece by means of at least one slide rail (15, 18; 115, 167; 118, 169) that is in its operating position in the transverse direction of the workpiece.

4. The bending machine in accordance with claim 3 wherein bending tools (10, 11; 110, 111) are provided on both sides of the tool platen (12, 112) with thrust members each in the form of at least one clamping jaw (14, 17; 114, 166; 117, 168) and at least one slide rail (15, 18; 115, 167; 118, 169), at least one clamping jaw (14, 17; 114, 166; 117, 168) on one side of tool platen and at least one clamping jaw (14, 17; 114, 166; 117, 168) on the other side of the tool platen (12, 112) being drivingly coupled for movement in the transverse direction of the workpiece and for movement in the opposite direction, whereby, as the workpiece is being bent, at least one of the slide rails (15, 18; 115, 167; 118, 169) of the active bending tool (10, 11; 110, 111), when in its operating position, can be moved in power-driven fashion in the longitudinal direction of and jointly with the workpiece.

5. The bending machine in accordance with claim 3 wherein at least one slide rail (15, 18; 115, 167; 118, 169) of the active bending tool (10, 11; 110, 111), when in its operating position in the transverse direction of the workpiece is movable with the workpiece in the longitudinal direction of the workpiece, and wherein at least one slide rail (15, 18; 115, 167; 118, 169) of a bending tool (10, 11; 110, 111) on the opposite side of the tool platen (12, 112) is coupled to be jointly driven in the longitudinal direction of the workpiece.

6. The bending machine in accordance with claim 5 wherein the slide rails (15, 18; 115, 167; 118, 169), are drivingly coupled for joint movement in the longitudinal direction of the workpiece, and can be moved in the same longitudinal direction of the workpiece on both sides of the tool platen (12, 112).

7. The bending machine in accordance with claim 3 wherein on one side of the tool platen (12, 112) at least one bending tool (10, 11; 110, 111) is provided with a bending swage (13, 16; 113, 164; 116, 165) featuring a larger bending radius than the bending swage (13, 16; 113, 164; 116, 165) of at least one bending tool (10, 11; 110, 111) on the opposite side of the tool platen (12, 112), wherein the respectively associated thrust members that can be moved in opposite ways in the transverse direction of the workpiece are provided in the form of opposite-sense clamping jaws (14, 17; 114, 166; 117, 168) and/or opposite-sense slide rails (15, 18; 115, 167; 118, 169), wherein, on the active bending tool (10, 11; 110, 111) at least one slide rail (15, 18; 115, 167; 118, 169), occupying its operating position in the transverse direction of the workpiece, can be power-driven in the longitudinal direction of and together with the workpiece as the workpiece is being bent, and that this slide rail (15, 18; 115, 167; 118, 169) can be drivingly coupled to at least one slide rail (15, 18; 115, 167; 118, 169) of a bending tool (10, 11; 110, 111) on the opposite side of the tool platen (12, 112) for travel, and permitting parallel movement, in the longitudinal direction of the workpiece.

8. A bending machine for the bending of rod-shaped and bar-shaped workpieces including:

(a) support for the workpiece:

(b) a tool platen (12, 112); and (c) a bending device (5, 105) comprising selectively deployable bending tools (10, 11; 110, 111), at least one of which is provided on one side of said platen and at least one other tool is provided on the opposite side of said tool platen (12, 112), each bending tool including at least one bending swage (13, 16; 113, 164; 116, 165) and at least one thrust member in the form of slide rails (15, 18; 115, 167; 118, 169), whereby the workpiece on the active bending tool (10, 11; 110, 111), as it is bent around the bending swage (13, 16; 113, 164; 116, 165), can be buttressed by means of at least one slide rail (15, 18; 115, 167; 118, 169) that is in its operating position in the transverse direction of the workpiece, whereby at least one slide rail (15, 18; 115, 167; 118, 169) of the active bending tool (10, 11; 110, 111), when in its operating position in the transverse direction of the workpiece, can be power-driven in the longitudinal direction of and jointly with the workpiece as the workpiece is being bent, and that the said slide rail (15, 18; 115, 167; 118, 169) is drivingly coupled to at least one idle slide rail (15, 18; 115, 167; 118, 169) of a bending tool (10, 11; 110, 111) on the opposite side of the tool platen (12, 112) for movement in the longitudinal direction of the workpiece.

9. The bending machine in accordance with claim 8, wherein the slide rails (15, 18; 115, 167; 118, 169), are drivingly coupled for movement in the longitudinal direction of the workpiece, and can be moved in parallel on both sides of the tool platen (12, 112) in the longitudinal direction of the workpiece.

10. The bending machine in accordance with claim 8 wherein the slide rails (15, 18; 115, 167; 118, 169), are drivingly coupled for movement in the longitudinal direction of the workpiece on both sides of the tool platen (12, 112), and are also drivingly coupled for travel in the transverse direction of the workpiece.

11. The bending machine in accordance with claim 8 wherein the slide rails (15, 18; 115, 167; 118, 169), are drivingly coupled for movement in the longitudinal direction of the workpiece on both sides of the tool platen (12, 112), and can be moved in an opposite sense along the transverse direction of the workpiece.

12. The bending machine in accordance with claim 8 wherein bending tools (10, 11; 110, 111) on both sides of the tool platen (12, 112) each employ thrust members in the form of at least one slide rail (15, 18; 115, 167; 118, 169) and at least one clamping jaw (14, 17; 114, 166; 117, 168), and wherein slide rails (15, 18; 115, 167; 118, 169) on both sides of the tool platen (12, 112) are drivingly coupled for movement in the longitudinal direction of the workpiece and in the transverse direction of the workpiece, while clamping jaws (14, 17; 114, 166; 117, 168) on both sides of the tool platen (12, 112) are drivingly coupled for movement in the transverse direction of the workpiece.

13. The bending machine in accordance with claim 1 including at least one common cross feed motor (26, 49) provided for the drive-coupled movement of thrust members such as clamping jaws (14, 17; 114, 166; 117, 168) and/or slide rails (15, 18; 115, 167; 118, 169) on both sides of the tool platen (12, 112) in the transverse direction of the workpiece.

14. The bending machine in accordance with claim 8 wherein at least common longitudinal drive motor (171) for the drive-coupled movement of slide rails (15, 18; 115, 167; 118, 169) on both sides of the tool platen (12, 112) in the longitudinal direction of the workpiece.

15. The bending machine in accordance with claim 8 wherein mutually associated thrust members on both sides of the tool platen (12, 112) can be moved in an opposite sense along the transverse direction of the workpiece by means of drive elements that permit opposite sense movement in the transverse direction of the workpiece and are motionally interconnected, that for each of these drive elements end stops are provided which serve in both directions of travel and which backstop the drive elements in the event of delayed movement and especially stoppage of the associated thrust member(s) while the drive elements nevertheless continue to move, and that between each drive element and one of its end stops a damping device (41, 42; 57, 58) is provided by means of which the impact of the drive element on the end stop can be attenuated, that in the case of an identical direction of travel of the drive elements functional end stops are attenuated, that when one of the drive elements would strike an unattenuated end stop the respective other drive element moving in the opposite direction will impinge on the end stop that functions in its own direction of travel and is attenuated by means of the damping device (41, 42; 57, 58), said drive elements that move in opposite directions being connected in attenuation-transferring fashion.

16. The bending machine in accordance with claim 15 wherein the opposite sense drive elements are provided in the form of spindles (31, 32; 51, 54) and/or spindle nuts (33, 35; 52, 55) of spindle drives (34, 36; 50, 53) to move the thrust members in the transverse direction of the workpiece.

17. The bending machine in accordance with claim 14 including a common longitudinal drive motor (171), moving the drive coupled slide rails (15, 18; 115, 167; 118, 169) in the longitudinal direction of the workpiece, is drive connected with the slide rails (15, 18; 115, 167; 118, 169) on both sides of the tool platen (12, 112) by way in each case of a longitudinal feedgear mechanism (178, 184) that encompasses a gear element (181, 187) movable in the transverse direction of the workpiece on the slide-rail side and, between that element and the longitudinal drive motor (171), a transmissive connection (183, 189), and that the transmissive connections (183, 189) between the longitudinal drive motor (171) and the gear elements (181, 187) on the slide rail side on both sides of the tool platen (12, 112) are each rotatable with their drive-motor side, jointly with the longitudinal drive motor (171), around the associated gear element (181, 187) on the slide rail side while being mutually connected in articulated fashion on their respective drive motor side, with the common linkage axle (177) of the transmissive connections (183, 189) on the drive motor side and the swivel pins (175, 176) of the transmissive connections (183, 189) on the gear elements (181, 187) on the slide rail side extending parallel to each other in the longitudinal direction of the workpiece.

18. The bending machine in accordance with claim 17 wherein the common linkage axle (177) of the transmissive connections (183, 189) on the drive-motor side is constituted of the motor shaft of the longitudinal drive motor (171).

19. The bending machine in accordance with claim 16 wherein at least one longitudinal feedgear mechanism (178, 184) disposed between the common longitudinal drive motor (171) and the slide rails (15, 18; 115, 167; 118, 169) encompasses a spindle drive (179, 185) with spindle drive elements in the form of a gear spindle (182, 188) that extends in the longitudinal direction of the workpiece and, mounted on it, a spindle nut (181, 187), that at least one slide rail (15, 18; 115, 167; 118, 169) is coupled with one of the spindle drive elements so as to permit movement in the longitudinal direction of the workpiece while the other spindle drive element constitutes a gear element on the slide-rail side, that the transmissive connection between the common longitudinal drive motor (171) and the spindle drive element in the form of the gear element on the slide-rail side is a continuous revolving drive element, capable of being powered by the common longitudinal drive motor (171), and in particular a drive belt (183, 189), by means of which the spindle drive element constituting the gear element on the slide-rail side can be moved around the axis of the gear spindle (182, 188).

20. The bending machine in accordance with claim 19 wherein the gear elements on the slide rail side on both sides of the tool platen (12, 112) are each positioned on a support that can be moved on the tool platen (12, 112) in the transverse direction of the workpiece, that on each support a rocker (173, 174) is mounted in a manner as to permit rotation around the swivel pin (175, 176) of the respective transmissive connection (183, 189), and that the rockers (173, 174) are linked together at a distance from their mounts on the supports with the common longitudinal drive motor (171) mounted on them, and that the common linkage axle (177) of the rockers (173, 174) and their swivel pins (175, 176) extend on the supports parallel to one another in the longitudinal direction of the workpiece.

* * * * *